US009592553B2

(12) United States Patent
Berglund

(10) Patent No.: US 9,592,553 B2
(45) Date of Patent: Mar. 14, 2017

(54) METHOD FOR MANUFACTURE OF A HIP CONSOLIDATED COMPONENT AND A HIP:ED COMPONENT COMPRISING A WEAR RESISTANT LAYER

(71) Applicant: SANDVIK INTELLECTUAL PROPERTY AB, Sandviken (SE)

(72) Inventor: Tomas Berglund, Falun (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/649,988

(22) PCT Filed: Nov. 28, 2013

(86) PCT No.: PCT/EP2013/074955
§ 371 (c)(1),
(2) Date: Jun. 5, 2015

(87) PCT Pub. No.: WO2014/086655
PCT Pub. Date: Jun. 12, 2014

(65) Prior Publication Data

US 2016/0184894 A1 Jun. 30, 2016

(51) Int. Cl.
*B22F 3/15* (2006.01)
*B22F 7/08* (2006.01)
(Continued)

(52) U.S. Cl.
CPC ..... *B22F 3/15* (2013.01); *B22F 1/0003* (2013.01); *B22F 5/00* (2013.01); *B22F 7/08* (2013.01);
(Continued)

(58) Field of Classification Search
CPC B22F 1/0003; B22F 2301/15; B22F 2302/10; B22F 2304/10; B22F 2998/10;
(Continued)

(56) References Cited

U.S. PATENT DOCUMENTS 3,305,326 A 2/1967 Longo
4,018,135 A 4/1977 Lance et al.
(Continued)

FOREIGN PATENT DOCUMENTS

CN 1035684 A 9/1989
CN 1055133 A 10/1991
(Continued)

OTHER PUBLICATIONS

Tan et al. Study on Wear Resistance of Ni-Base Alloy Spray-Welding Coating Reinforced by WC Particles, Tribology, vol. 16, No. 03; Sep. 30, 1996, pp. 202-207.
(Continued)

*Primary Examiner* — Jessee Roe
*Assistant Examiner* — Nicholas Wang
(74) *Attorney, Agent, or Firm* — Corinne R. Gorski

(57) ABSTRACT

A method for manufacturing of a wear resistant component including the steps of providing a form defining at least a portion of the shape of the component; providing a powder mixture comprising 30-70 vol % of a powder of tungsten carbide and 70-30 vol % of a powder of a nickel based alloy, wherein the nickel based alloy consists of, in weight %: C: 0-1.0; Cr: 0-14.0; Si: 2.5-4.5; B: 1.25-3.0; Fe: 1.0-4.5; the balance being Ni and unavoidable impurities, and wherein the powder of tungsten carbide has a particle size of 105-250 μm and the powder of the nickel based alloy has a maximum particle size of 32 μm; filling at least a portion of the form with the powder mixture; and subjecting the form to Hot Isostatic Pressing at a predetermined temperature, a predetermined isostatic pressure and a for a predetermined time so that the particles of the nickel-based alloy bond metallurgically to each other.

15 Claims, 7 Drawing Sheets

(51) Int. Cl.

| | |
|---|---|
| ***B25D 9/14*** | (2006.01) |
| ***C22C 19/03*** | (2006.01) |
| ***C22C 29/08*** | (2006.01) |
| ***C22C 32/00*** | (2006.01) |
| ***C22C 19/05*** | (2006.01) |
| ***B22F 1/00*** | (2006.01) |
| ***B22F 5/00*** | (2006.01) |

(52) U.S. Cl.
CPC ..... *B25D 9/145* (2013.01); *C22C 19/03* (2013.01); *C22C 19/058* (2013.01); *C22C 29/08* (2013.01); *C22C 32/0052* (2013.01); *B22F 2301/15* (2013.01); *B22F 2302/10* (2013.01); *B22F 2304/10* (2013.01); *B22F 2998/10* (2013.01)

(58) Field of Classification Search
CPC ..... B22F 3/15; B22F 5/00; B22F 7/08; B25D 9/145; C22C 19/03; C22C 29/08
See application file for complete search history.

(56) References Cited

U.S. PATENT DOCUMENTS 5,149,597 A * 9/1992 Holko ..... C22C 19/058 420/452
5,880,382 A * 3/1999 Fang ..... C22C 1/051 175/374
2005/0117984 A1* 6/2005 Eason ..... B22F 3/15 408/144
2010/0009089 A1 1/2010 Junod et al.
2010/0108399 A1 5/2010 Eason et al.
2012/0247028 A1* 10/2012 Konyashin ..... B23B 27/148 51/309

FOREIGN PATENT DOCUMENTS

| | | | |
|---|---|---|---|
| CN | 2158931 | Y | 3/1994 |
| CN | 1680624 | A | 10/2005 |
| CN | 101596593 | A | 12/2009 |
| CN | 102453902 | A | 5/2012 |
| EP | 1857204 | A1 | 11/2007 |
| JP | 61-186406 | A | 8/1986 |
| JP | H0649581 | A | 2/1994 |

OTHER PUBLICATIONS

Hao et al. Tungsten Carbide Composite Coatings Prepared by Sintering Method, Rare Metal Materials and Engineering vol. 36, Aug. 15, 2007, pp. 739-741.

* cited by examiner

METHOD FOR MANUFACTURE OF A HIP CONSOLIDATED COMPONENT AND A HIP:ED COMPONENT COMPRISING A WEAR RESISTANT LAYER

RELATED APPLICATION DATA

This application is a §371 National Stage Application of PCT International Application No. PCT/EP2013/074955 filed Nov. 28, 2013 claiming priority of EP Application Nos. 12196122.1 filed Dec. 7, 2012 and 13174907.9, filed Jul. 3, 3013.

TECHNICAL FIELD

The present invention relates to a method for manufacturing of a HIP consolidated component a HIP consolidated component and a powder mixture for manufacturing of a HIP consolidated component.

BACKGROUND ART

Components that are subjected to wear, such as abrasion resistant components in mining applications, are typically provided with a layer of wear resistant material. In certain cases the entire component may be manufactured in a wear resistant material.

Plasma transferred arc welding (PTAW) is a conventional method for manufacturing of wear resistant coatings on products. In PTAW, a powder mixture of hard tungsten carbide particles and ductile metal powder is fed through a nozzle into a plasma, in which the powder is fused so that the solid tungsten carbide particles are suspended in molten metal powder. The fused powder is transferred onto the surface of the steel component where it solidifies into a wear resistant layer that comprises hard tungsten carbide particles in a matrix of a relatively ductile metal binder phase. In wear resistant layers, the volume ratio of the hard and ductile phases as well as their distribution is very important for the performance and overall life length of the wear resistant layer.

However, wear resistant layers that have been applied by PTAW suffer from several drawbacks. For instance, during solidifying of wear resistant layers applied by PTAW, the alloy elements segregate in the molten metal matrix and cause inclusions of e.g. borides and carbides to grow rapidly into large blocks or elongated needle like shapes. As the inclusions grow, they connect with each other and form brittle networks in the ductile metal phase between adjacent tungsten carbide particles, hence reducing the ductility of the wear resistant layer. FIG. 9 shows a SEM image of a portion of conventional PTAW applied material. In the image, networks of interconnected needle- and block shaped borides and carbides are visible in the matrix between the large white tungsten particles.

Also, due to differences in density between tungsten carbide and the metal alloy of the binder phase, the tungsten carbides tend to sink towards the bottom of the applied wear resistant layer. This causes a lower concentration of hard particles in the surface region of the wear resistant layer, thus reducing the hardness of the wear resistant layer. FIG. 8 shows a portion of conventional PTAW applied material in which the surface zone has few tungsten carbide.

It is further difficult to manufacture thick wear resistant layers with PTAW since thermal stress is created in the layers during solidifying. Furthermore, it is difficult to use PTAW for applying wear resistant layers to components of complicated shapes.

Hence, it is an object of the present invention to solve at least one of the above mentioned problems. In particular, it is an object of the present invention to achieve a method which allows for manufacturing components with improved wear resistance. A further object of the present invention is to achieve a component which has high wear resistance. Yet a further object of the present invention is to provide a powder mixture which allows manufacturing of components with high wear resistance.

SUMMARY OF THE INVENTION

According to a first aspect of the invention at least one of the above objects is achieved by a method for manufacturing of a wear resistant component comprising the steps:

- providing a form defining at least a portion of the shape of the component;
- providing a first powder, wherein the first powder is powder mixture comprising 30-70 vol % of a powder of tungsten carbide and 70-30 vol % of a powder of a nickel based alloy, wherein the nickel based alloy consists of, in weight %:
  C: 0-1.0; Cr: 0-14.0; Si: 2.5-4.5; B: 1.25-3.0; Fe: 1.0-4.5; the balance Ni and unavoidable impurities; and wherein the powder of tungsten carbide has a particle size of 105-250 μm and the powder of the nickel based alloy has a maximum particle size of 32 μm;
- filling at least a portion of said form with said powder mixture;
- subjecting said form to Hot Isostatic Pressing (HIP) at a predetermined temperature, a predetermined isostatic pressure and for a predetermined time so that the particles of the nickel-based alloy bond metallurgical to each other.

A main advantage of the inventive method is that the entire HIP process is performed at a temperature below the melting point of the nickel based alloy so that the nickel based alloy particles are diffusion bonded to each other. During HIP, borides and carbides are precipitated in the nickel based alloy matrix. The growth rate and also the shape of the borides and nitride precipitations are limited by the diffusion rate of alloy elements through the solid matrix. The borides and carbides precipitated in the matrix are therefore small, typically having a particle size from 5 to 10 μm and distributed as single, discrete particles in the ductile matrix material.

In a HIP:ed component that is manufactured by the inventive method, this advantageous since the small and discretely distributed precipitations of borides and carbides strengthens the ductile nickel based alloy matrix without causing excessive brittleness. This mechanism prevents so called "wash-out" of the matrix and increases therefore the wear resistance of the component.

Regarding the powder mixture that is employed in the inventive method, it is important that the mean size of the particles of nickel based alloy is relatively small in comparison the mean size of the tungsten carbide particles. This has the effect that the powder mixture can be blended and handled in such way that essentially all tungsten carbide particles are individually embedded in the nickel based alloy particles and distributed evenly in the powder mixture. Or, in other words, such that essentially each tungsten particle is completely surrounded by nickel based alloy particles. By "essentially all" is meant that only a very small fraction of the tungsten carbide particles are in contact with each other. By the term "evenly" is meant the distance between adjacent tungsten particles approximately is constant throughout a volume of powder mixture.

In a HIP:ed component that is manufactured by the inventive method, the homogenous distribution of discrete, non-interconnecting tungsten particles in a nickel based alloy matrix will yield a uniform hardness throughout the component and hence a high wear resistance.

DETAILED DESCRIPTION OF THE INVENTION

Figure 1:
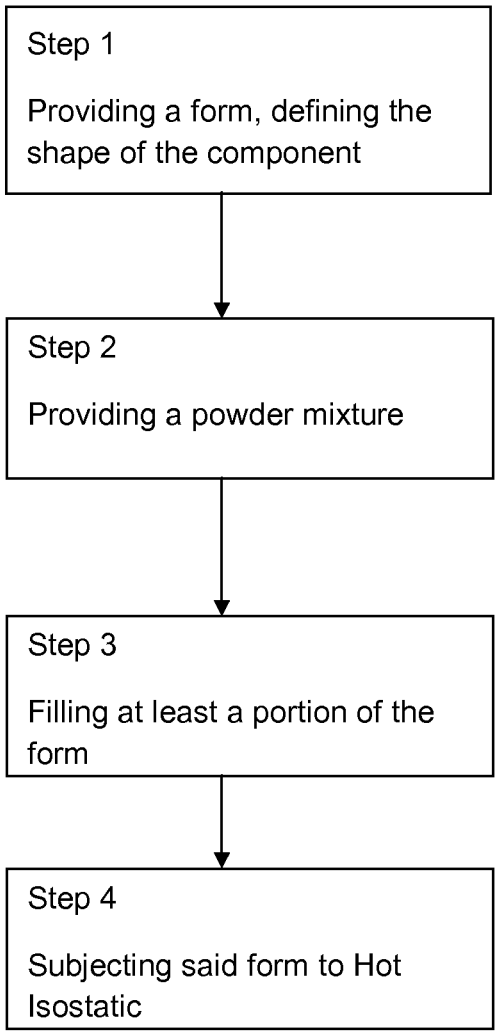
FIG. 1: A flow chart showing the steps of the inventive method for manufacturing a HIP consolidated component.

FIG. 1 shows schematically the steps of the inventive method.

Figure 2A:
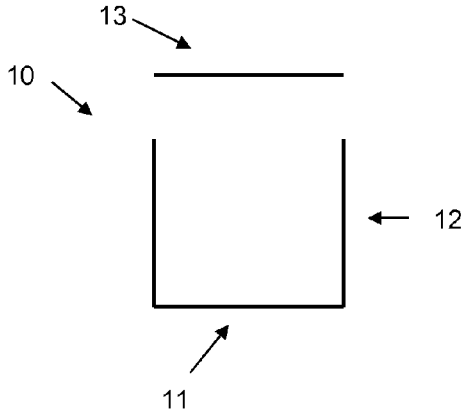
FIGS. 2*a* and 2*b*: Schematic drawings moulds that are used in the inventive method for manufacturing a HIP consolidated component.
Figure 2B:
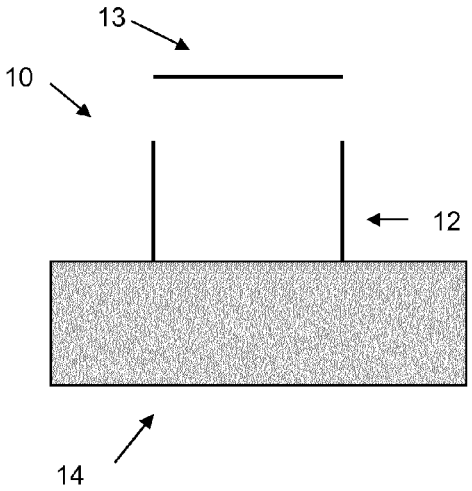

In a first step, a form 10 is provided. The form 10, also referred to as mould or capsule, is shown in side view in FIG. 2*a* and defines at least a portion of the shape or contour of the final component. The form 10 is typically manufactured from steel sheets, such as carbon steel sheets that are welded together. The form may have any shape. In FIG. 2*a*, the form defines the outer shape of a cylinder and has a circular bottom plate 11, a circumferential outer wall 12 and a cover 13 which is sealed to the outer wall 12 by welding after filling of the form. The form 10 may also define a portion of the final component. In that case the form 10 is welded to a pre-manufactured component 15, for example a forged or cast component. The form 10 is thereby designed such that one of the walls of the form is constituted by a surface of the pre-manufactured component 15, see FIG. 2*b*. This has the advantage that pre-manufactured components may be provided with a layer of wear resistant material.

In a second step a powder mixture is provided. According to the invention the powder mixture consists of a powder of tungsten carbide particles and a powder of a nickel based alloy. The tungsten carbide particles may be WC or $W_2C$ or a mixture of WC and $W_2C$. The tungsten carbide particles may be of spherical or facetted shape. The size, i.e. the sieve size, of the tungsten particles is 105-250 μm. This should be understood such that the powder mixture comprises a mixture of tungsten particles of different sizes between 105 μm up to 250 μm. According to a variant the sieve size of the tungsten particles is 150-200 μm. In the final HIP:ed component, the very hard tungsten particles provide abrasion resistance.

The powder of the nickel based alloy constitutes the ductile phase in the final consolidated component. The powder of the nickel based alloy has the following composition in weight % (wt %): C: 0-1.0; Cr: 0-14.0; Si: 2.5-4.5; B: 1.25-3.0; Fe: 1.0-4.5; the balance Ni and unavoidable impurities. The nickel based alloy is strong and ductile and therefore very suitable as matrix material in abrasive resistant applications.

Carbon forms together with chromium and iron, small metal rich carbides, for example $M_{23}C_6$ and $M_7C_3$ that are precipitated in the ductile nickel based alloy matrix. The precipitated carbides strengthen the matrix by blocking dislocations from propagating. Preferably, the powder of the nickel based alloy comprises at least 0.25 wt % carbon in order to ensure sufficient precipitation of metal rich carbides. However, too much carbon could lead to precipitation of graphite which reduces the ductility of the matrix and therefore carbon should be limited to 1.0 wt %. For example, the amount of carbon is 0.25-0.35 or 0.5-0.75 wt %. It is believed that carbon may promote the dissolving of the tungsten carbides and in certain applications, carbon should therefore be 0 wt % in the matrix.

Chromium is important for corrosion resistance and to ensure the precipitation of chromium rich carbides and chromium rich borides. Chromium is therefore preferably included in the nickel based alloy matrix in an amount of at least 5 wt %. However, chromium is a strong carbide former and high amounts of chromium could therefore lead to increased dissolving of tungsten carbide particles. Chromium should therefore be limited to 14 wt %. For example, the amount of chromium is 5.0-9.5 wt % or 11-14 wt %. In certain applications it is desirable to entirely avoid dissolving of the tungsten carbide particles. In that case the content of chromium could be 0 wt % in the nickel based alloy matrix Silicon is used in the manufacturing process of the nickel based alloy powder and may therefore be present in the nickel based alloy matrix, typically in an amount of at least 0.5 wt % for example, 2.5-3.25 wt % or 4.0-4.5 wt %. Silicon may have a stabilizing effect on tungsten rich carbides of the type $M_6C$ and the content of silicon should therefore be limited to 4.5 wt %.

Boron forms chromium and iron rich borides, which contribute to precipitation hardening of the nickel based alloy matrix. Boron should be present in an amount of at least 1.25 wt % to achieve a significant precipitation hardening effect. However, the solubility of boron in nickel, which constitutes the main element in the matrix, is limited and therefore the amount of boron should not exceed 3.0 wt. For example, the amount of boron is 1.25-1.8 wt % or 2.0-2.5 wt % or 2.5-3.0 wt %.

Iron is typically included in the scrap metal from which the nickel based alloy powder is manufactured. Iron has a positive effect on the strength of the nickel based alloy matrix as it forms borides and carbides. At least 1 wt % Iron should therefore be present in the nickel based alloy powder. High amounts of iron could however lead to dissolving of the tungsten carbide particles and iron should therefore be limited to 4.5 wt %. For example iron is present in an amount of 1.0-2.5 wt % or 3.0-4.5 wt %.

Nickel constitutes the balance of the nickel based alloy. Nickel is suitable as matrix material since it is a rather ductile metal and also because the solubility of carbon is low in nickel. Low solubility of carbon is an important characteristic in the matrix material in order to avoid dissolving of the tungsten particles. Nickel is further inexpensive in comparison to cobalt, another conventional matrix material, Examples of suitable compositions of the nickel based alloy are:

C: 0.1; Si: 2.3; B: 1.25; Fe 1.25; the balance Ni and unavoidable impurities.

C: 0.1; Si: 2.3; B: 1.75; Fe 1.25; the balance Ni and unavoidable impurities.

C: 0.1; Si: 3.2; B: 1.25; Fe 1.25; the balance Ni and unavoidable impurities.

C: 0.25; Cr: 5.0; Si: 3.25; B: 1.25; Fe: 1.0; the balance Ni and unavoidable impurities.

C: 0.35; Cr: 8.5; Si: 2.5; B: 1.25; Fe: 1.0; the balance Ni and unavoidable impurities.

C: 0.35; Cr: 9.5; Si: 3.0; B: 2.0; Fe: 3.0; the balance Ni and unavoidable impurities.

C: 0.5; Cr: 11.5; Si: 4.0; B: 2.5; Fe: 3.0; the balance Ni and unavoidable impurities.

C: 0.75; Cr: 14.0; Si: 4.0; B: 2.0; Fe: 4.5; the balance Ni and unavoidable impurities.

The nickel based alloy particles have a substantially spherical shape, alternatively a deformed spherical shape.

The size of the nickel based alloy particles is ≤32 μm. The size may be determined with laser diffraction, i.e. analysis of the "halo" of diffracted light produced when a laser beam passes through a dispersion of particles in air or in liquid. The maximum size is selected to 32 μm in order to ensure that the alloy particles completely surround each of the larger tungsten carbide particles. According to alternatives, the maximum size of the nickel based alloy particles is 30 μm, 28 μm, 26 μm, 24 μm or 22 μm.

Figure 3A:
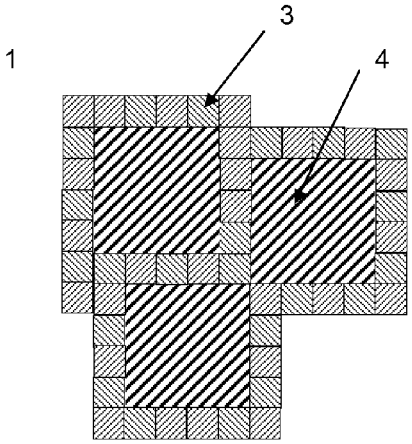
FIGS. 3*a* and 3*b*: Schematic drawings comparing the inventive nickel based alloy powder with conventional powder.
Figure 3B:
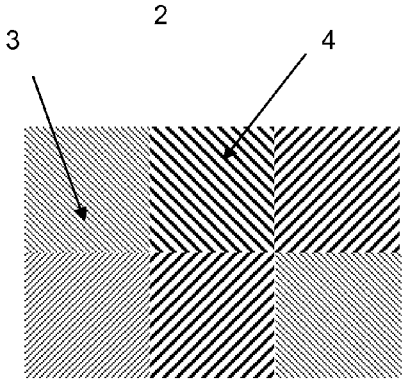

The importance of the size of alloy particles in the inventive powder is in the following explained with reference to FIGS. 3*a* and 3*b*. FIG. 3*a* shows a sample 1 of the inventive powder mixture in which the alloy particles 3 have a size of 32 μm. FIG. 3*b* shows schematically a sample 2 of a conventional powder mixture having large alloy particles 3, for example 125 μm. The size of the tungsten carbide particles 4 are the same in samples 1 and 2, for example 125 μm. The samples 1 and 2 have also the same volume V.

Since the alloy particles 3 in the inventive sample 1 are substantially smaller than the alloy particles 3 in sample 2 there are, under the condition that the volumes V of the two samples 1 and 2 are the same, many more alloy particles in sample 1 than there are alloy particles in sample 2.

Therefore, as can be seen in FIG. 3*a*, there are sufficient alloy particles 3 in the inventive sample 1 to surround the large tungsten carbide particles 4. In the comparative sample 2 shown in FIG. 3*b*, the alloy particles 3 are larger and the sample volume V does therefore not contain enough alloy particles 3 to completely surround the tungsten carbide particles 4.

The nickel based alloy particles are present in the powder mixture over a wide range of particle sizes from the maximum size of 32 μm down to fractions of a micron.

When a large fraction of the nickel based alloy particles have very small sizes the powder mixture tend to agglomerate and it becomes difficult to blend the powder mixture to a degree where all tungsten carbide particles are completely embedded in particles of the nickel based alloy powder. Agglomeration also causes problem with the flowability of the powder mixture.

Therefore the nickel based alloy particles should be selected such that the d50 for the nickel based alloy particles is 6-20 μm, more preferred 10-15 μm. The sizes of the particles in the nickel based alloy powder are approximately normal distributed. The term "d50" means thereby that 50% of the particles have a size which is smaller than a specific value that lies in the range of 6-20 μm, more preferred 10-15 μm. For example in the nickel based alloy powder $D_{50}$ may be 20 μm, 19 μm 18 μm, 17 μm, 16 μm 15 μm 14 μm 13 μm 12 μm, 11 μm, 10 μm.

The powder of tungsten carbide particles is mixed with the powder of nickel based alloy particles in a ratio of 30-70 vol % of tungsten carbide powder and the remainder nickel based alloy powder.

The exact volume ratio between the tungsten carbide powder and the nickel based alloy powder in the inventive powder mixture is determined by the wear condition in the application that the consolidated component is intended for. However, with regard to the tungsten carbide powder, the lowest acceptable amount is 30 vol % in order to achieve a significant resistance to abrasion. The amount of tungsten carbide powder should not exceed 70 vol % since the HIP:ed component then may become too brittle. It is further difficult to blend or mix amounts of tungsten carbide powder exceeding 70 vol % with the Nickel based alloy particles to a degree where essentially all the tungsten carbide particles are completely embedded in the nickel based alloy powder.

The volume ratio may for example be 40 vol % tungsten carbide powder and 60 vol % nickel based alloy powder, or 50 vol % tungsten carbide powder and 50 vol % of nickel based alloy powder, or 45 vol % tungsten carbide powder and 55 vol % of nickel based alloy powder.

In a third, step the tungsten carbide powder and the nickel based alloy powder are blended into a powder mixture. Blending is preferably performed in V-type mixture. The blending step ensures that the tungsten carbide particles are distributed uniformly in the volume of inventive powder mixture and that essentially all tungsten carbide particles are individually embedded in nickel based alloy powder.

In a fourth step, the powder mixture is poured into the form 10 that defines the shape of the component. The form is thereafter sealed, for example by welding the cover 13 onto the circumferential wall 12. Prior to sealing the form 10, a vacuum may be applied to the powder mixture, for example by the use of a vacuum pump. The vacuum removes the air from the powder mixture. It is important to remove the air from the powder mixture since air contains argon, which has a negative effect on ductility of the matrix.

In a fifth step the filled form is subjected to Hot Isostatic Pressing (HIP) at a predetermined temperature, a predetermined isostatic pressure and a for a predetermined time so that the particles of the nickel based alloy bond metallurgical to each other. The form is thereby placed in a heatable pressure chamber, normally referred to as a Hot Isostatic Pressing-chamber (HIP-chamber).

The heating chamber is pressurized with gas, e.g. argon gas, to an isostatic pressure in excess of 500 bar. Typically the isostatic pressure is 900-1200 bar. The chamber is heated to a temperature which is below the melting point of nickel based alloy powder. The closer to the melting point the temperature is, the higher is the risk for the formation of melted phase and unwanted streaks of brittle carbide—and boride networks. Therefore, the temperature should be as low as possible in the furnace during HIP:ing. However, at low temperatures the diffusion process slows down and the material will contain residual porosity and the metallurgical bond between the particles becomes weak. Therefore, the temperature is 900-1150° C., preferably 1000-1150° C. The form is held in the heating chamber at the predetermined pressure and the predetermined temperature for a predetermined time period. The diffusion processes that take place between the powder particles during HIPP:ing are time dependent so long times are preferred. Preferable, the form should be HIP:ed for a time period of 0.5-3 hours, preferably 1-2 hours, most preferred 1 hour.

During HIP:ing the particles of the nickel based alloy powder deform plastically and bond metallurgically through various diffusion processes to each other and the tungsten particles so that a dense, coherent article of diffusion bonded nickel based alloy particles is formed. In metallurgic bonding, metallic surfaces bond together flawlessly with an interface that is free of defects such as oxides, inclusions or other contaminants.

After HIP:ing the form is stripped from the consolidated component. Alternatively, the form may be left on the component.

It is possible to take a sample of the HIP:ed component, etching the surface of the sample and determine in SEM (Scanning Electron Microscope) that the particles are diffusion bonded to each other.

According to a preferred embodiment of the present invention, the component is an impact hammer for a hammer mill. Hammer mills are known in the art and will therefore only be described briefly. Typically, a hammer mill comprises a drum into which material to be crushed, such as rocks or ore, is introduced. In the drum a shaft is rotatable arranged and on the rotatable shaft impact hammers are arranged. When the shaft is rotated, the impact hammers swing around the shaft and impacts on the ore which is crushed.

FIG. 11 shows schematically an impact hammer 100 according to the invention. The impact hammer consist of a shank 110 and a hammer head 120. A first end 111 of the shank extends into the hammer head 120. The other, second, end 112 of the shank comprises a through hole 130 for rotatable attaching the impact hammer to a shaft in a hammer mill (not shown in FIG. 11). The hammer head 120 has a rectangular parallelepiped shape comprising a top surface 121, which is facing away from the skank 110 and four side surfaces (in FIG. 11 only two surfaces 122 and 123 are visible). The hammer head 120 has further a lower surface (not visible in FIG. 11) from which the skank 110 extends. It is obvious that the hammer head could have other shapes than parallelepiped. For example the hammer head could have a facetted irregular shape or a round shape.

According to the invention, at least a portion of the outer surface of the hammer head 120 comprises a HIP:ed wear resistant layer 140 which comprises particles of tungsten carbide having a particle size of 105-250 μm and a matrix of diffusion bonded particles of a nickel based alloy, wherein the nickel based alloy consists of C: 0-1.0; Cr: 0-14.0; Si: 2.5-4.5; B: 1.25-3.0; Fe: 1.0-4.5; the balance Ni and unavoidable impurities and wherein the particle size of the diffusion bonded particles of the nickel based alloy is <32 μm. Typically, the wear resistant layer 140 has a thickness of 5-50 mm, preferably 15-25 mm.

The HIP:ed wear resistant layer 140 constitutes at least the top surface 121 of the hammer head. The wear resistant layer 140 may also constitute one, several or all of the side surfaces of the hammer head. Preferably, the HIP:ed wear resistant layer 140 constitute the top surface 121 and the side surfaces which are directed in the rotational direction of the hammer mill shaft, e.g. side surface 122 and the opposite side surface (which is not shown in FIG. 11).

The skank and the remaining portion of the hammer head typically consists of steel or cast iron such white cast iron. Ferritic steel alloys, such as common construction steel or the commercially available steel 410L are especially preferred. This because the low Coefficient of Thermal Expansion (CTE) of ferritic steel alloys which results in minimized stress in the wear resistant layer after cooling from the HIP-temperature during manufacturing of the impact hammer. Other suitable steel materials are high speed steel or tool steel (for example).

The wear resistant layer is applied onto the inventive impact hammer by HIP. FIGS. 11*a*-11*d* show schematically the steps of manufacturing the inventive impact hammer according to a first alternative.

In a first step a pre-manufactured core 128 is provided for example by forging or casting or powder metallurgy. The pre-manufactured hammer core 128 consists of the skank 110 and a hammer head core 129. The dimensions of the hammer head core 129 equals the size of the final hammer head minus the wear resistant layer 140.

In a second step a form 10 is provided. The form 10 defines at least a portion of the shape of the final hammer head, i.e. the portion of the hammer head which comprises the wear resistant layer. However, it is of course possible that the form 10 defines the entire hammer head or the entire impact hammer. The form is manufactured from steel sheets that are welded together.

Figure 11A:
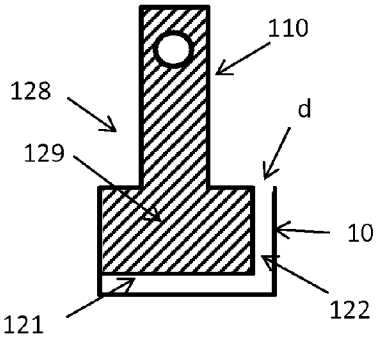
FIG. 11*a-d*: Schematic drawings illustrating the steps for manufacturing a component according to a first alternative of the invention.

The form 10 and the pre-manufactured core 128 are arranged relative each other such that the form 10 encloses the portion of the hammer head core 129 onto which the wear resistant layer shall be applied, see FIG. 11*a*. In FIG. 11*a*, the form 10 encloses the sides 121 and 122 of the hammer head core. Due to the differences in dimension between the hammer core and the form, a spacing d is achieved between the hammer head core 129 and the form 10. The spacing d defines the dimensions of the thickness of the wear resistant layer on the final impact hammer. The spacing d between the hammer head and the form is therefore 5-50 mm, preferably 15-25 mm.

Figure 11B:
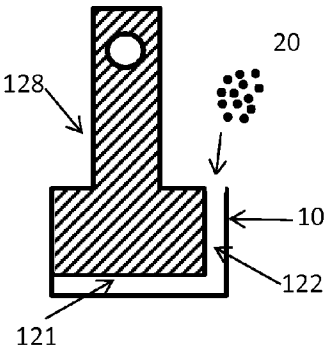

In a subsequent step, see FIG. 11*b*, the form 10 is filled with the inventive powder mixture 20. The form may be filled with powder prior to, or after, the form is arranged relative the hammer head core. In some cases it may also be necessary to first fill some powder into the form, then arranging the hammer core in the form and subsequently filling the rest of the form with powder.

Figure 11C:
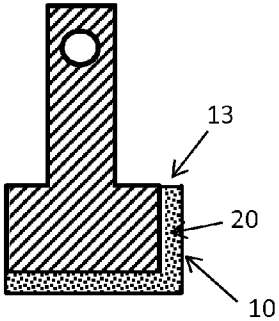

After filling, see FIG. 11*c*, the form is sealed air tight. This may be achieved by welding the form to the hammer head core and by also welding a lid 13 over any opening in the form. Prior thereto, air may be removed from the form by vacuuming (not shown).

Subsequently the form and the hammer core is subjected to HIP at a predetermined temperature, a predetermined isostatic pressure and for a predetermined time so that the particles the inventive powder mixture bond metallurgical to each other and to the hammer head core and form a dense and coherent wear resistant layer on the hammer core.

Figure 11D:
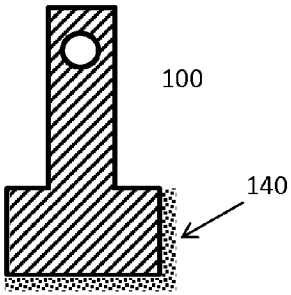

In a final step, the form 10 is removed, for example by grit blasting or pickling and leaves the wear resistant layer exposed (see FIG. 11*d*). It is also possible to leave the form 10 on the final impact hammer.

According to a second alternative of the invention, the entire impact hammer is manufactured from powder. FIG.

12*a*-12*c* shows schematically the steps of the method for manufacturing the impact hammer according to a second alternative of the invention.

Figure 12A:
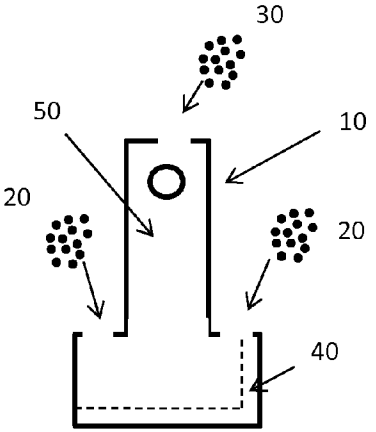
FIG. 12*a-c*: Schematic drawings illustrating the steps for manufacturing a component according to a second alternative of the invention.

In a first step, see FIG. 12*a*, a form 10 which defines the shape of the entire impact hammer is manufactured. A first portion 40, indicated by dashed lines, of the form 10 defines the shape of the wear resistant layer. A second portion 50 of the form 10 defines the remainder of the impact hammer, i.e. the core of the impact hammer.

Figure 12B:
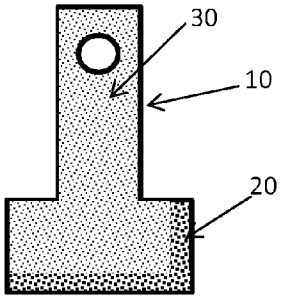
Figure 12C:
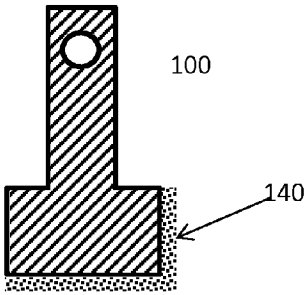

The form 10 is thereafter filled with powder. The first portion 40 of the form is filled with the inventive powder mixture 20 and the second portion 50 of the form is filled with a second powder 30. The second powder a metal powder, such as a steel powder or cast iron powder. As described earlier the second powder 30 is preferably a ferritic steel alloy powder, such as 410L. Typically the second powder has a particle size of <500 μm, preferably 10-500 μm. It is obvious that the inventive powder mixture and the second powder can be introduced into the form in any order to ensure that the form is filled properly. The two powders may also be introduced simultaneous or alternating. FIG. 12*b* shows the filled form 10.

Subsequently, the form is vacuumed, sealed and subjected to HIP at a predetermined temperature, a predetermined isostatic pressure and for a predetermined time so that the particles of the first and second powder bond metallurgical to each other and form a dense and coherent impact hammer with a wear resistant coating.

Above an inventive component and methods for manufacturing thereof has been described in detail with reference to an impact hammer. However also other components could be provided with a wear resistant layer as described above. Examples of such components are a Double Roll Crusher Tooth, a Crusher tooth for Secondary and/or Tertiary Crushers, a Wear Segment or a plate for crushers and components in slurry handling systems, e.g. impellers of pipe bends. Of course it is also possible to combine the above described methods.

EXAMPLE

The invention will in the following be described with reference to a non-limiting example.

Firstly, a test sample was prepared of the inventive powder mixture.

The test sample contained 50 vol % WC-powder and 50 vol % of a powder of a nickel based alloy powder having the following composition in weight %: C: 0.75; Cr: 14.0; Si: 4.0; B: 2.0; Fe: 4.5; the balance Ni. The WC-powder had a size of 105-250 μm and the nickel based alloy powder had a maximum size of 32 μm, 90% of the powder mass was smaller than 22 μm and 50% was smaller than 13 μm (i.e. a d50 of 13 μm.

The WC powder and the nickel based alloy powder were mixed to a homogenous blend in a V-blender. Thereafter a mould, manufactured from steel sheets, was filled with the powder mixture and placed in a heatable pressure chamber, i.e. Hot Isostatic Pressing-chamber (HIP-chamber).

The heating chamber was pressurized with argon gas to an isostatic pressure 1000 bar. The chamber was heated to a temperature of 1100° C. and the sample was held at that temperature for 2 hours.

After HIP:ing the mould was stripped from the sample and the sample was subjected to abrasion testing.

The sample was subjected to standardized "dry sand rubber wheel testing" to determine the resistance to abrasive wear. The sample was weighted before and after the dry sand a rubber wheel testing and with the aid of the density of the sample the volume loss of each sample was determined as a measure of abrasion.

The volume loss of the inventive sample was determined to 6.1 $mm^3$

This is considered to be a very low volume loss under abrasive conditions and hence an evidence of that the inventive material has a very high abrasion resistance.

As comparison, standardized "dry sand rubber wheel testing" of conventional PTAW applied wear resistant coatings have shown volume losses in the magnitudes of 11-16 $mm^3$.

The inventive sample was also studied in a Carl Zeiss SEM in various magnifications.

Figure 4:
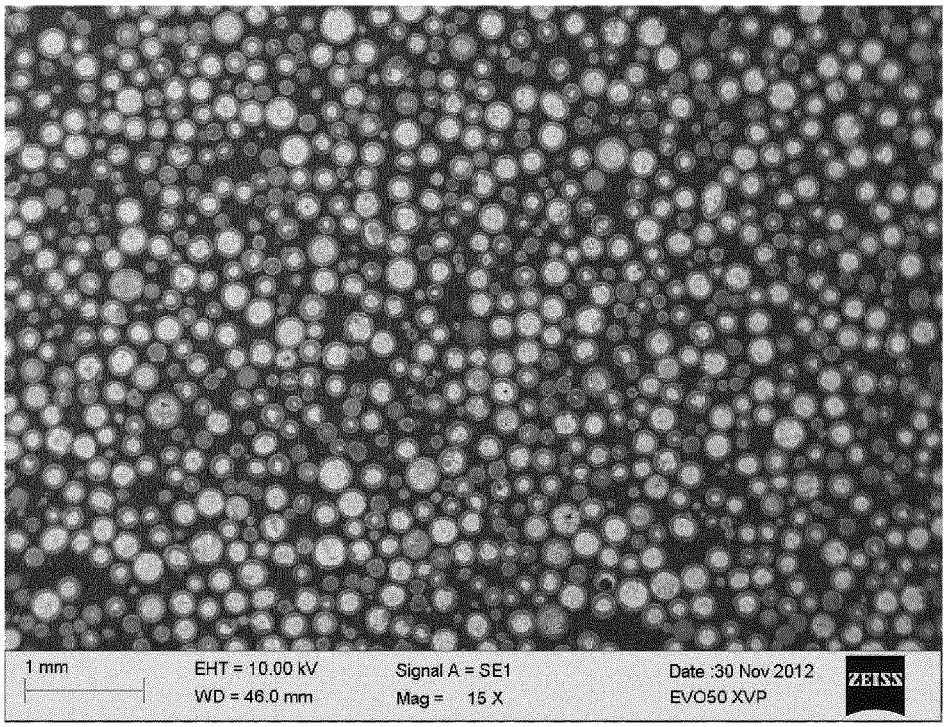
FIG. 4: An SEM picture in 15× magnification of a sample of an inventive component.

FIG. 4 shows an SEM image of the sample. It is clear from FIG. 2 that the large round tungsten carbide particles 3 are evenly distributed throughout the cross section of the consolidated component and also that essentially each single tungsten carbide particle individually is surrounded by the nickel based alloy matrix.

Figure 5:
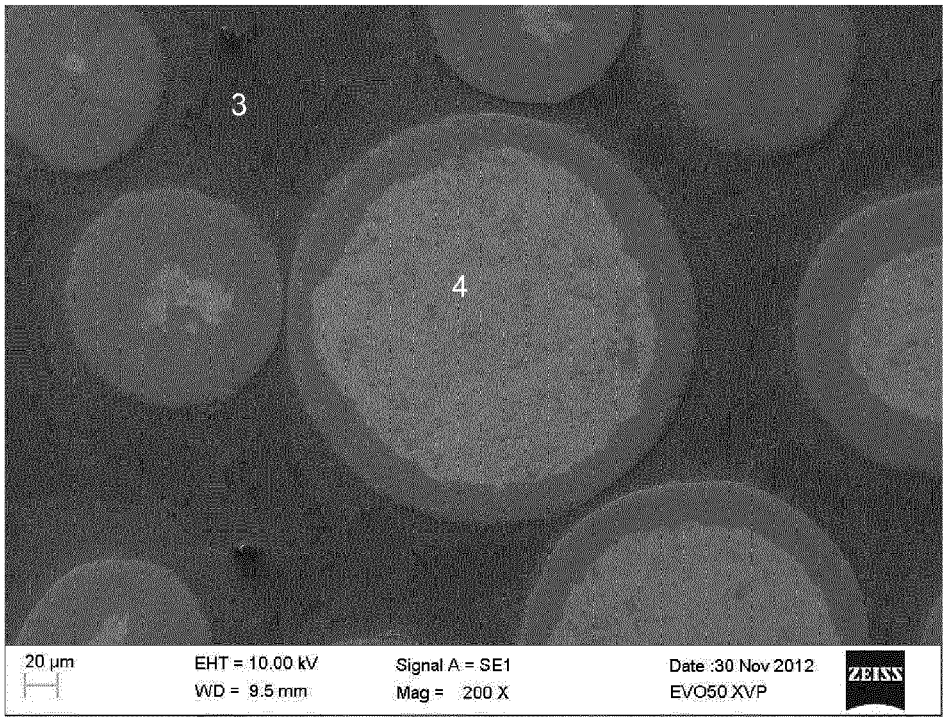
FIG. 5: An SEM picture in 200× magnification of a sample of an inventive component.

FIG. 5 shows a portion of the image in FIG. 4 in 200× magnification. In this image, it is clear that the tungsten carbide particles 4 are present as discrete, individual particles in the surrounding metal nickel based alloy matrix 3.

Figure 6:
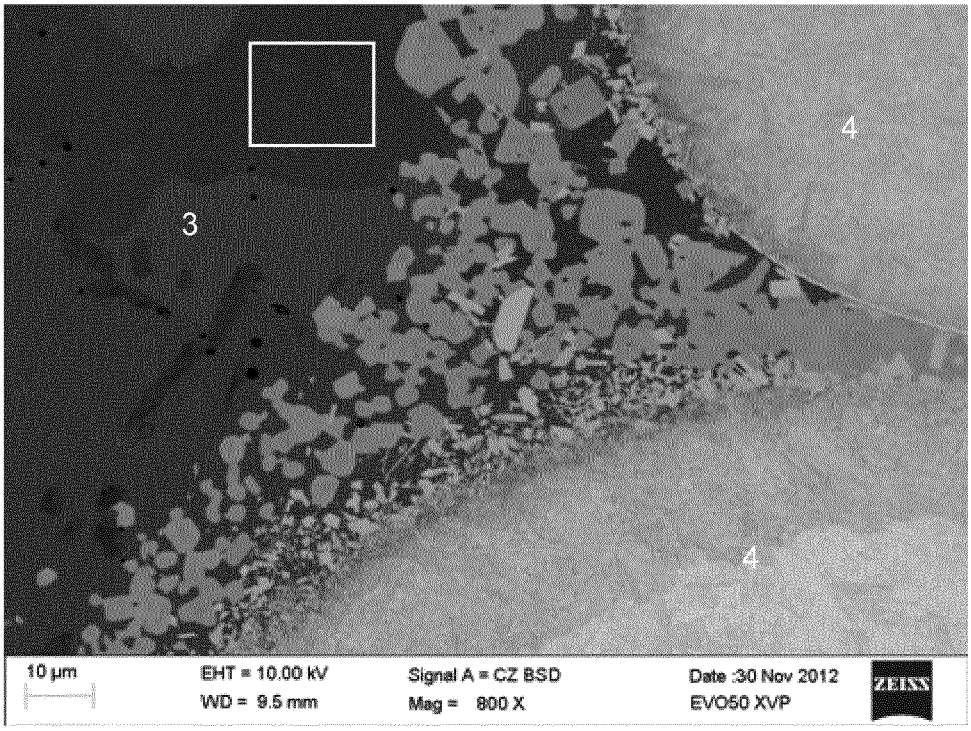
FIG. 6: An SEM picture in 800× magnification of a sample of an inventive component.

FIG. 6 is a portion of the image in FIG. 4 in 800× magnification. To the right in the image are a portion of two round tungsten carbide particles 4 visible. Next to the tungsten carbide particles is an area of metal rich carbide. The metal rich carbides have been formed in that the round tungsten carbides have been dissolved and the carbon released thereby has been reacted with metal elements, such as chromium and iron in the matrix. The encircled area shows a portion of the dark nickel based alloy matrix 3, in this portion, small and light areas are visible. These are precipitations of carbides and borides that have been precipitated in the alloy matrix during HIP:ing of the sample.

Figure 7:
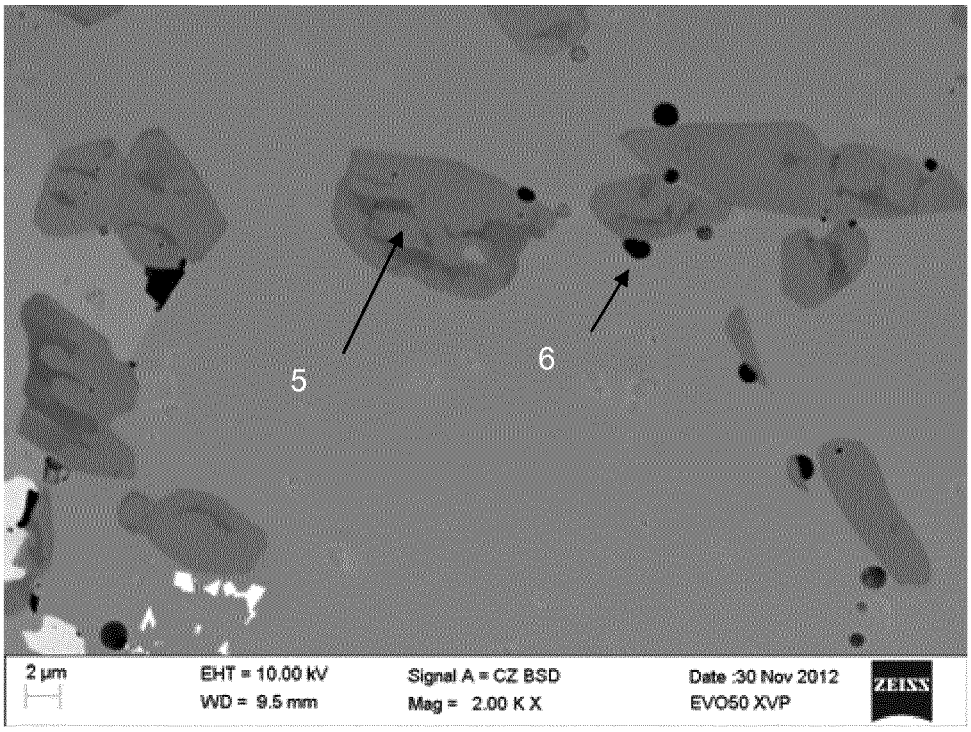
FIG. 7: An SEM picture in 200 K× magnification of a sample of an inventive component.
Figure 8:
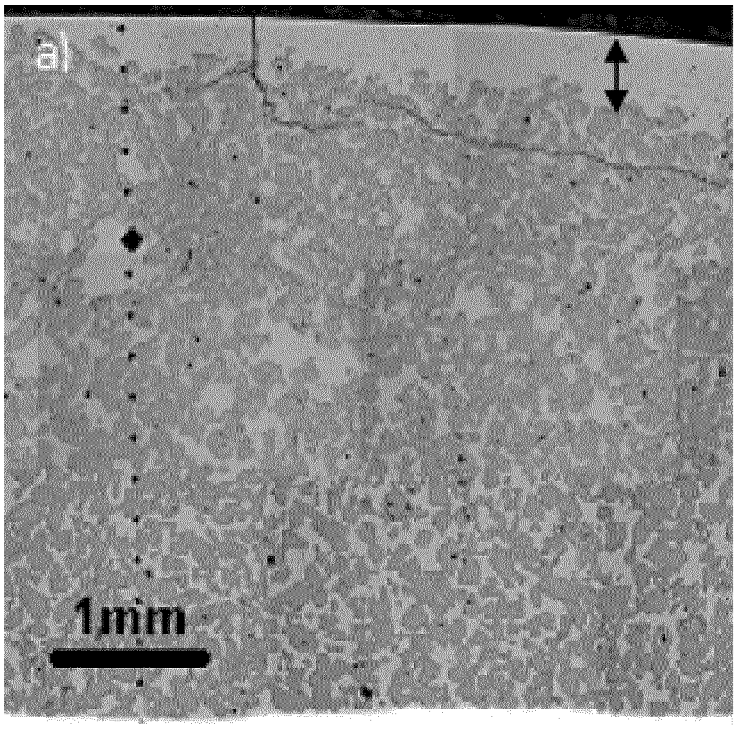
Figure 8 (Prior Art)
FIG. 8: A picture of a portion of PTAW applied material according to the Prior Art.
Figure 9:
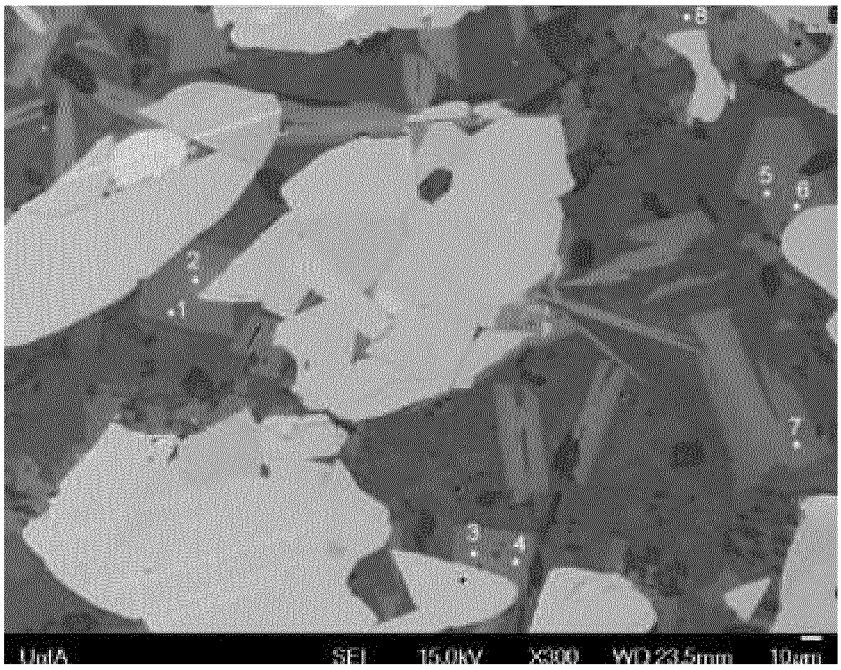
Figure 9 (Prior Art)
FIG. 9: An SEM image of a portion of PTAW applied material according to the Prior Art.
Figure 10:
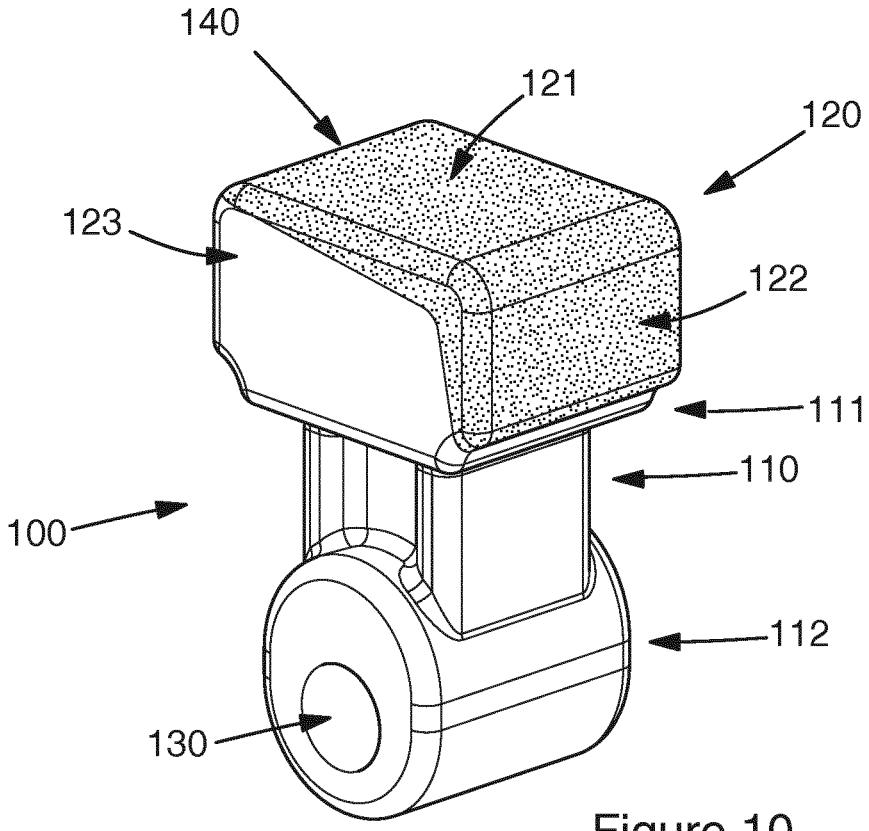
FIG. 10: A schematic drawing of a component according to a preferred embodiment of the invention.

FIG. 7 shows the encircled portion of FIG. 6 in 2.00 K× magnification. In this magnification, the precipitations in the encircled are of FIG. 5 are clearly visible. From the image it can be derived that the precipitations have a size of approximately 6-10 μm and are dispersed in the matrix as discrete particles, essentially without contact to each other. The round, black dots 6 are believed to be a result of sample preparation as well as small non-metallic inclusions.

The invention claimed is:

1. A method for manufacturing of a wear resistant component comprising the steps:

providing a form defining at least a portion of the shape of the component;

providing a first powder, wherein said first powder is a powder mixture comprising 30-70 vol % of a powder of tungsten carbide and 70-30 vol % of a powder of a nickel based alloy, wherein the nickel based alloy consists of, in weight %: C: 0-1.0; Cr: 0-14.0; Si: 2.5-4.5; B: 1.25-3.0; Fe: 1.0-4.5; the balance being Ni and unavoidable impurities; and wherein the powder of tungsten carbide has a particle size of 105-250 μm and the powder of the nickel based alloy has a maximum particle size of 32 μm;

filling at least a portion of said form with said first powder mixture; and subjecting said form to Hot Isostatic Pressing (HIP) at a predetermined temperature, a predetermined isostatic pressure and for a predetermined time so that the particles of the nickel-based alloy bond metallurgically to each other.

2. The method according to claim 1, wherein the powder of the nickel based alloy has a maximum particle size of 22 μm.

3. The method according to claim 1, wherein a $D_{50}$ of the size distribution of the particles in the powder of the nickel based alloy is 6-20 μm.

4. The method according to claim 1, wherein the content of carbon in the nickel based alloy is 0.25-1.0 wt %.

5. The method according to claim 1, wherein the content of chromium in the nickel based alloy is 5-14 wt %.

6. The method according to claim 1, wherein the nickel based alloy consists of, in weight %: C: 0.5-0.75, Cr: 11-14, Si: 4.0-4.5; B: 2.0-2.5; Fe: 3.0-4.5, the balance being nickel and unavoidable impurities.

7. The method according to claim 1, wherein the component comprises a pre-manufactured core and a wear resistant layer which extends on at least a portion of the pre-manufactured core, further comprising the steps of:

providing a pre-manufactured core;

arranging the pre-manufactured core relative the form such that the form surrounds at least a portion of the pre-manufactured core which is to be provided with a wear resistant layer;

filling the form with the first powder such that at least the portion of the pre-manufactured core that is to be provided with a wear resistant layer is covered with the first powder; and subjecting the form, the component core and the first powder to Hot Isostatic Pressing (HIP) at a predetermined temperature, a predetermined isostatic pressure and a for a predetermined time so that the particles of the first powder bond metallurgically to the pre-manufactured core.

8. The method according to claim 1, wherein the component comprises a core and wear resistant layer which extends on at least a portion of the core, wherein a first portion of the form defines the shape of the wear resistant layer and a second portion of the form defines the shape of the core, the method further comprising the steps of:

filling the first portion of the form with the first powder;

filling the second portion of the form with a second powder; and subjecting the form to Hot Isostatic Pressing (HIP) at a predetermined temperature, a predetermined isostatic pressure and a for a predetermined time so that the particles of the first and the second powder bond metallurgically to each other.

9. The method according to claim 8, wherein the second powder is a metal powder selected from the group of a steel powder, a cast iron powder, and a ferritic steel powder.

10. A HIP:ed wear resistant component comprising particles of a powder of tungsten carbide having a particle size of 105-250 μm and a matrix of diffusion bonded particles of a powder of nickel based alloy, wherein the powder of nickel based alloy consists of (in weight %)

C: 0-1.0;

Cr: 0-14.0;

Si: 2.5-4.5;

B: 1.25-3.0;

Fe: 1.0-4.5;

the balance being Ni and unavoidable impurities and wherein the particle size of the the nickel based alloy is ≤32 μm.

11. The HIP:ed wear resistant component according to claim 10, wherein the particles of tungsten carbide are distributed as discrete non-interconnecting particles in the matrix of nickel based alloy.

12. The HIP:ed wear resistant component according to claim 10 wherein the matrix of nickel based alloy includes precipitated particles of borides and carbides, wherein the particles of boride and carbide are dispersed as discrete, individual particles in the matrix and wherein the size of the boride and carbide particles is 5-10 μm.

13. The HIP:ed wear resistant component according to claim 10, wherein the precipitated particles are iron and/or chromium rich borides and iron and/or chromium rich carbides.

14. The HIP:ed wear resistant component selected from the group of an impact hammer; a double roll crusher tooth; a crusher tooth for secondary and/or tertiary crushers; a wear segment for crushers; a wear plate for crushers; or a component for a slurry handling systems, wherein the component includes a HIP:ed wear resistant layer, the wear resistant layer including a powder of particles of tungsten carbide having a particle size of 105-250 μm and a matrix of diffusion bonded particles of a powder of nickel based alloy, wherein the powder of nickel based alloy consists of C: 0-1.0; Cr: 0-14.0; Si: 2.5-4.5; B: 1.25-3.0; Fe: 1.0-4.5; the balance being Ni and unavoidable impurities and wherein the particle size of the particles of the nickel based alloy is <32 μm.

15. A powder mixture for manufacture of wear resistant components comprising: 30-70 vol % of a powder of tungsten carbide and 70-30 vol % of a powder of a nickel based alloy, wherein the nickel based alloy consists of, in weight %: C: 0-1.0; Cr: 0-14.0; Si: 2.5-4.5; B: 1.25-3.0; Fe: 1.0-4.5; the balance being Ni and unavoidable impurities; and wherein the powder of tungsten carbide has a particle size of 105-250 μm and the powder of the nickel based alloy has a maximum particle size of 32 μm.

* * * * *